United States Patent [19]

Anderson

[11] 4,317,461

[45] Mar. 2, 1982

[54] METAL PLATED HAIR ROLLER

[76] Inventor: George W. Anderson, 17744-1st. St. East, Redington Shores, Fla. 33708

[21] Appl. No.: 207,794

[22] Filed: Nov. 17, 1980

Related U.S. Application Data

[63] Continuation-in-part of Ser. No. 861,946, Dec. 19, 1977.

[51] Int. Cl.[3] ..... A45D 2/00

[52] U.S. Cl. ..... 132/40; 132/33 R

[58] Field of Search ..... 132/40–42, 132/39

[56] References Cited

U.S. PATENT DOCUMENTS 3,220,422 11/1965 Schrodor ..... 132/40

3,286,716 11/1966 Liaros ..... 132/42 R 3,527,237 9/1970 Abe ..... 132/40

3,594,543 7/1971 Wallin ..... 132/33 R

*Primary Examiner*—G. E. McNeill

*Attorney, Agent, or Firm*—Stevens, Davis, Miller & Mosher

[57] ABSTRACT

A metallized hair roller for use in curling hair by wrapping strands of hair around the outer surface of the roller, securing the hair on the roller with a magnetic holder, clip or similar device and applying heat from an external heat source to the inner surface of the hair roller. The hair roller has an elongated hollow cylindrical plastic body which is encased in a composite metal coating of electrolytic metals creating a thermal energy cell.

27 Claims, 14 Drawing Figures

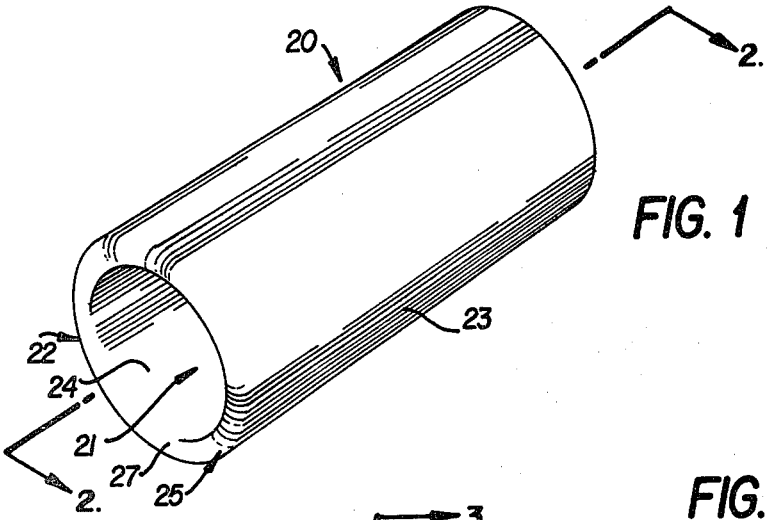
FIG. 1
FIG. 2
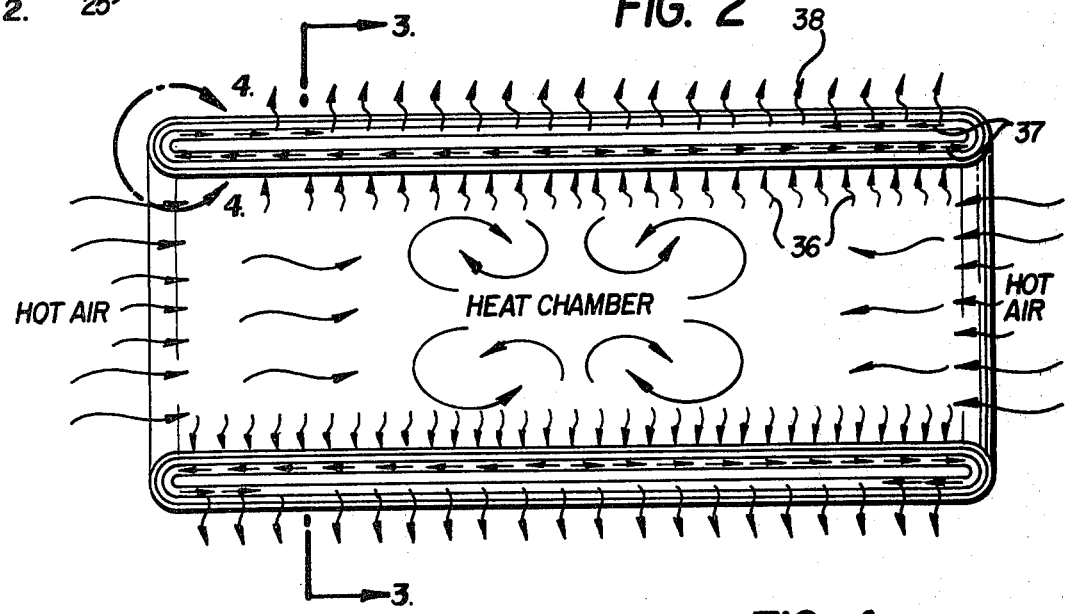
FIG. 3
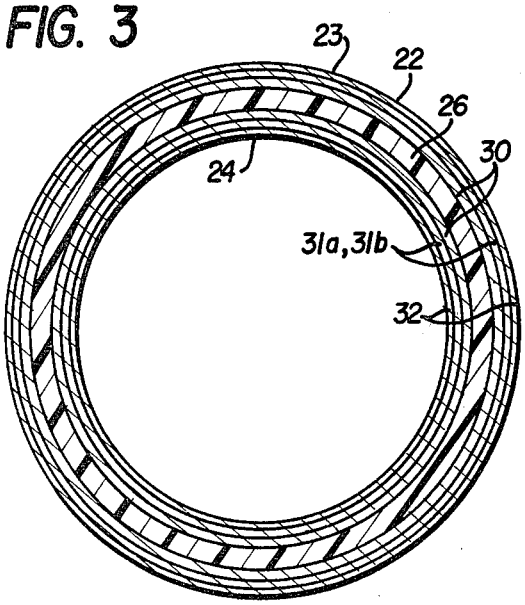
FIG. 4
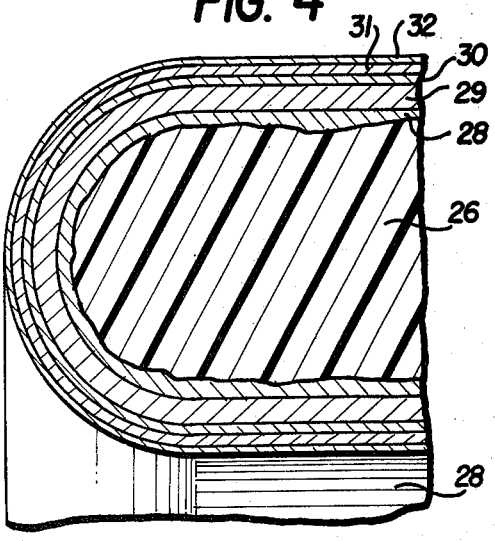

METAL PLATED HAIR ROLLER

This application is a continuation-in-part of my pending application Ser. No. 861,946 filed Dec. 19, 1977.

This invention relates to a hair roller having a combination of metal coatings on the inner and outer surfaces of a hollow cylindrical plastic body joined at the radius. The inner metal surface is capable of heat conductance, storage and transmission to the outer metal surface where the heat dissipates by radiation to the hair strands to be dried.

This invention incorporates not only a thermal plate composite in order to conserve energy but may utilize a magnetic field as a catalyst to the thermal conductance of the thermal plate composite. This magnetic field may be created in a temporary state with a permanent magnet holder which may be associated with the roller or in a permanent state utilizing a magnetic core substrate in the roller.

Many types of hair rollers are known in the art for setting a curl or wave in the hair. Most hair rollers have a hollow tubular body. Many plastic types are in use today for curling hair by winding a plurality of strands of wet hair on the outside surface of the roller and drying the wound strands with a hot air blower dryer, or the like. The rollers vary in diameter depending on the type of curl desired. It has been the practice in hair curling or setting to wash the hair prior to the setting and to set the hair while it is wet. The theory is that wet hair will stretch and when dried on a roller will take the shape of the roller, the result being curls. Most hair rollers are secured with a hair clip or roller clip to retain the hair on the roller and in the hair. As the hair drys the hair trys to return back to its normal length and tightens around the hair roller. When completely dried, the rollers are removed and the curls are combed into a finished hair style.

Most commercially available plastic hair rollers which do not have their own heater are made of polyvinyl chloride which softens when heated and in time becomes distorted and stained by chemicals to which the roller is exposed. Electric hair curlers which are preheated in an electric heater before setting operate on a decreasing heat principal. If the heat stored is not adequate to dry the hair on the first setting, then the roller must be removed, reheated and the hair reset. These rollers are mostly used as a home product for they are impractical for use in a beauty salon, and because they have prongs which kink the hair, making it very difficult to obtain a professional looking comb out. The power consumption is also very great. The heaterless plastic and the electrical hair roller may be held in place with a pincurl clip or a roller clip. Both clips work on spring tension and have a tendency to work their way loose and fall out of the hair. There are other kinds of hair rollers, for example, brush-type and rubber foam-type rollers. Both are used only in home use. Most state health boards will not permit their use in professional beauty salons for sanitation reasons.

The largest energy consumer in the beauty salon is the salon chair type hair dryer used in drying hair after rolling.

It is an object of this invention to provide a hair roller device for curling hair which is devoid of the foregoing disadvantages. Another object of the invention is to provide a hair roller which requires a relatively short drying time or lower drying temperatures due to the thermal characteristics of its thermal cell plate. A further object of the invention is to provide a hair roller which is adapted to be sterilized with strong disinfectants or with boiling water. Still another object of the invention is to provide a hair roller which has a hard and durable metal surface which is substantially impervious to chemicals to which it is exposed during a hair curling operation and will not lose its shape when exposed to high temperatures. A still further object of the invention is to provide a hair roller which is free from sharp edges which damage the hair and from prongs which might irritate the scalp. Still another object of the invention is to provide a roller for use in curling hair having a surface to which wet hair will cling when wrapped therearound. A more specific object of the invention is to provide a roller for use in curling hair which has improved heat absorption, heat conducting and heat radiation properties. Another object of the invention is to provide a hair roller adapted to employ a magnetic field of either a temporary or permanent nature as a catalyst to the drying process and securing the hair therearound.

Other objects will become apparent from the following description with reference to the accompanying drawing wherein FIG. 1 is a perspective view of one embodiment of a hair roller of this invention having a deposited metal plate covering its inner and outer surface;

FIG. 2 is a longitudinal section taken on the line 2—2 of FIG. 1 showing the wall construction of one embodiment of the hair roller with a curved end portion of the wall construction, and a metal plate covering the outer surface of the wall construction and shows the thermal conductance, transmission and radiation of the thermal plate;

FIG. 3 is a cross-section taken on the line 3—3 of FIG. 2 showing the wall construction of the embodiment of the hair roller of FIG. 2;

FIG. 4 is an enlarged fragmentary cross-section taken on the line 4—4 of FIG. 2;

Figure 7:
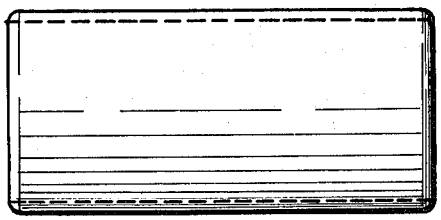
Figure 7A:
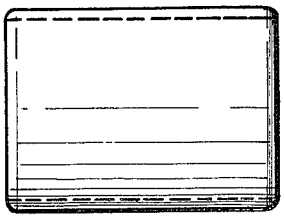
Figure 8:
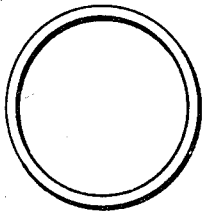
Figure 9:
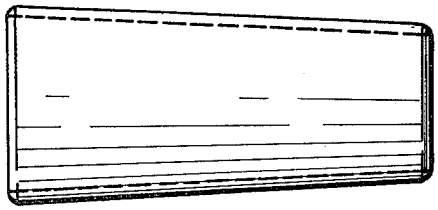
Figure 9A:
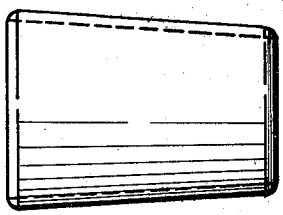
Figure 10:
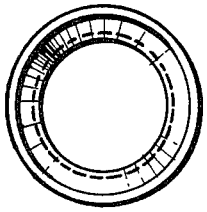
Figure 11:
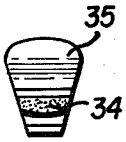
Figure 12:
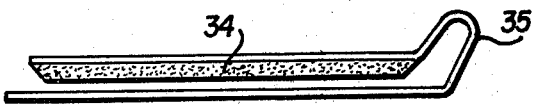
Figure 12A:
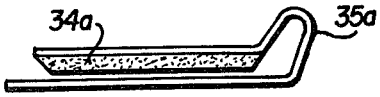
Figure 13:
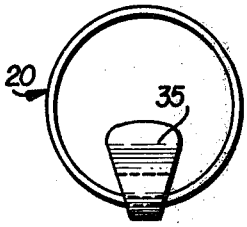
Figure 14:
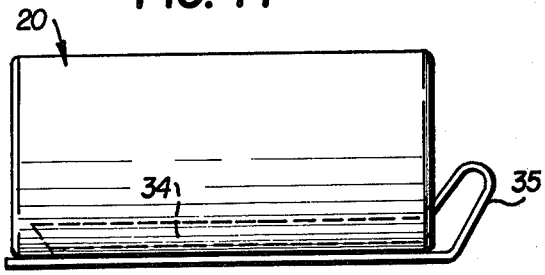

FIGS. 7 and 7*a* are diagrammatic illustrations of long and short cylindrical roller bodies;

FIG. 8 is a cross-section of FIG. 7;

FIGS. 9 and 9*a* are diagrammatic longitudinal views of long and short frusto-conical embodiments of the roller of this invention;

FIG. 10 is a cross-section of the embodiment of FIG. 9;

FIG. 11 is an end view of a magnetic roller holder illustrated in FIG. 12;

FIGS. 12 and 12*a* are longitudinal views of the long and short versions of the magnetic roller holder of this invention;

FIG. 13 is an end view of the magnetic holder on the roller of this invention; and FIG. 14 is a longitudinal view of the magnetic holder on the roller of this invention.

The hair roller of the present invention is an improvement over the art because, inter alia, it provides a more sanitary, safer, durable and energy efficient hair drying operation. A preferred embodiment of the hair roller is formed by first forming a hollow plastic body such as by extrusion or injection molding of a metal plateable grade of plastic, or the like and then encasing this plastic substrate body within a composite of electolytic metal coatings, such as by electroplating.

The hollow body may be in the form of a hollow cylinder or hollow semi-cone in which the ends of the elongated hollow body have a curved radius which joins the inner surface to the outer surface and provides a metal plated hair roller that is devoid of sharp ends which may cause damage to the hair.

It has been found that conventional electroplating processes used in plating plastics for decorative and aesthetic purposes sometimes will not withstand the alternate heating and cooling required of a hair roller, nor will it act as an efficient conductor of heat. Therefore, it is preferred to coatthe surface of the roller by an electroforming process which provides a much heavier or thicker metal coating of certain electrolytic metals. In order to form a thermal cell, the plates must be continuous and substantially completely enclose the plastic substrate in a sandwich manner with the electrolytic plate on opposite surfaces integral with each other at the rounded ends of the roller. The total thickness of metal on the surface of the roller should be at least 1.5 mils for best results.

Electrolytic copper is a particularly advantageous plating material because it can be used to control the differential in coefficient of thermal expansion between the plastic substrate and a nickel plate resulting when the roller is alternately heated and cooled.

Moreover, a copper plate has the highest rate of thermal conductance.

An external nickel plate is advantageous because of its resistance to chemical attack by chemicals used in curling hair.

It is therefore used to protect the underlying copper plate which will react chemically with hydrogen peroxide, bleaches, ammonia and the like contained in beauty products.

In addition a nickel plate is an excellent base material for magnetic attraction of the magnetic holders and has excellent properties for magnetization. The nickel plate is magnetic.

It was also found that electrolytic chromium as a finish coat is very desirable due to its tight molecular structure which resists discoloration and provides a hard, high luster and durable surface. This highly polished plated surface is slick and smooth, creating a surface which attracts wet hair to cling thereto which facilitates handling of the hair and the setting of the hair into waves or curls at a faster rate.

Advantageously, flash coatings of other electrolytic non-reacting plates like gold, brass or bronze may be applied to the chromium finished plate for aesthetic value and to color code the different roller sizes.

It is also advantageous to use magnetic holders to secure the hair on the rollers; for the first time the professional hairdresser will have a means to secure rollers in the hair as the rollers will not become loose or fall out because a hair clip or roller clip works loose.

The magnetic holders magnetize the roller metal plate which in turn assists in the hair drying process.

It is also advantageous to add a magnetic substance to the plastic body of the hair roller with a permanent magnetic field which will accelerate the thermal conductance of the thermal plate composite.

Referring now to FIGS. 1, 2 and 3 of the drawing, a hair roller 20 has a hollow plastic body 21 with a wall 22 having an outer cylindrical surface 23, and a substantially concentric inner cylindrical surface 24. The wall has end surfaces 25 which are curved so that there are no sharp edges. The inner and outer cylindrical surfaces of the wall 22 are etched to form a roughened surface to improve adhesion of the coating.

As shown in FIG. 4, the metallic plate on surfaces 23 and 24 of the illustrated embodiment has a series of layers 28, 29, 30, 31 and 32. In a first embodiment, layer 28 is a nickel plate about 0.01 mil thick deposited by immersion on the roughened or etched surface 27 which may be about 0.008–0.04 mil deep, layer 29 is an electroplate nickel about 0.01 mil thick, layer 30 is electroplated copper about 0.7 mil thick, layer 31 is a semi-bright nickel about 0.5 mil thick covered with bright nickel about 0.3 mil thick, and layer 32 is chromium about 0.01 mil thick.

In a second embodiment the plating on ABS surface 26 is composed of the same layers 27, 28 and 29 as the plating described above for the first embodiment, layer 30 is electroplated copper about 0.6 mil, layer 31 is a composite of semi-bright nickel plate 0.4 mil thick and bright nickel 0.4 mil thick, and chromium surface layer 32 about 0.01 mil.

In a third embodiment of the plating on the roller illustrated in FIG. 4, ABS synthetic resin body having an etched surface 27 at a depth of 0.008–0.04 mil, has coatings 28 and 29 like the corresponding layers of the first embodiment, an electroplated copper layer 30 0.8 mil thick, an electroplated composite layer 31 of semi-bright nickel 0.6 mill and bright nickel 0.4 mil and a chromium layer 32 0.01 mil on its surface.

Figure 5:
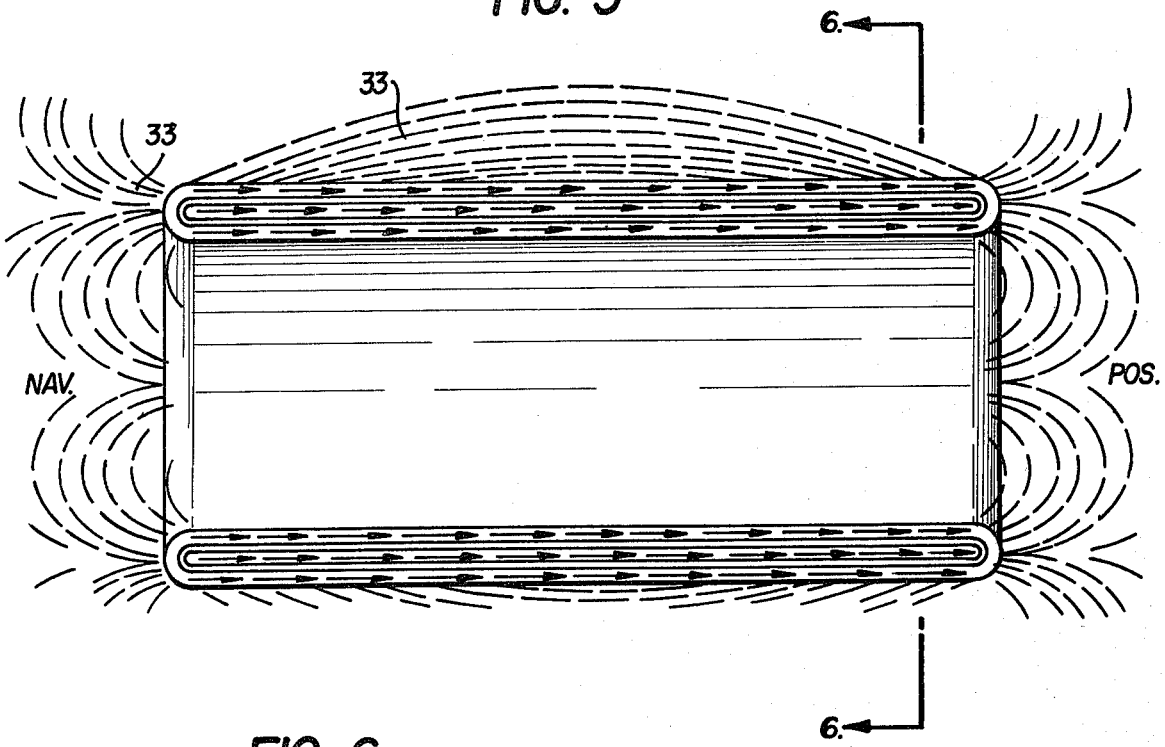
FIG. 5 is a longitudinal section of an embodiment of the hair roller of the invention similar to that of FIG. 2 and showing a magnetic field of the magnetized thermal plate having barium ferrite embedded in the plastic.
Figure 6:
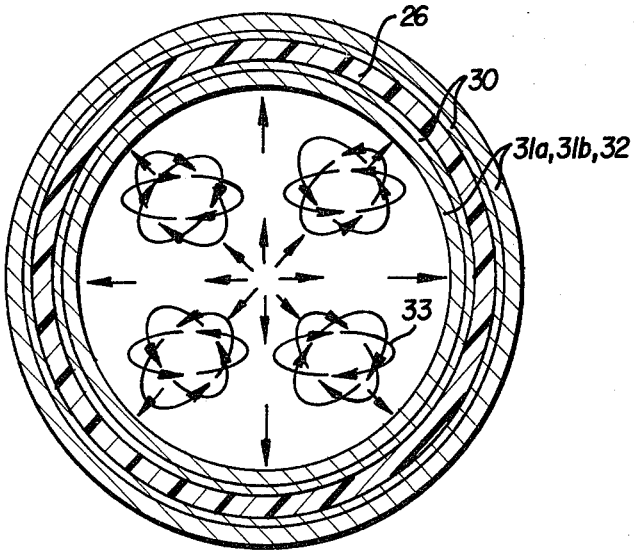
FIG. 6 is a cross-section taken along the line 6—6 of FIG. 5.

Hollow cylindrical body 26 of the roller of this invention may be molded from a plastic having metal embedded therein. Alternately, a standard plateable grade of plastic of the acrylonitrile-butadiene and styrene type ABS), polypropylene, phenylene oxide-based polymer, polysulfone and polyaryl ethers may be used;. Also it has been found that barium ferrite or a magnetite embedded in the plastic body of the hair roller to provide a true magnetic hair roller. The hair roller of FIGS. 6 and 7 will produce a magnetic field which acts as a catalyst accellerating the thermal conductance of the hair roller when heated.

FIGS. 8, 8*a*, 9, 10, 10*a* and 11 illustrate various shapes the roller may take. The size of such rollers may be from one-half inch in diameter to about three inches in diameter and may vary in length from about one and one-fourth inches to about three inches; the wall thickness may vary from about 0.020 to 0.15 of an inch.

FIGS 12, 13, 13*a*, 14 and l4*a* illustrate magnetic holders having a contact area 34 containing barium ferrite. Area 34 locks magnetically to the nickel plate of the hair roller holding the prong 35 firmly in position and retaining the roller in the hair.

The magnetic holder will temporarily magnetize the nickel plate of the roller when used with a roller with an ABS or metal embedded plastic core and produce a magnetic field which acts as a catalyst accelerator of the thermal conductance of the hair roller when heated. However, this magnetic field will only be present as long as the magnetic holder is in contact with the roller's metal plate.

The magnetic effect can be created in a temporary or permanent state. The temporary state is obtained when a non-magnetic core is used like ABS or a carbon embedded plastic having carbon particles embedded therein. However a heavier thermal plate is desirable.

This temporary magnetic state occurs when the magnetic holder is attached to the roller.

The thermal metal plate applied to the surface of the hollow plastic substrate produces a hair roller that is capable of faster heating when an outside source of heat is applied to it and is also capable of holding heat and producing even radiant heat to the strands of hair wrapped around its outer surface, drying the ends of the hair which are close to the surface first. Maeanwhile, the hot air from the hair dryer is drying the outermost hair first as it always does.

A permanent magnetic state can be achieved with a core which contains barium ferrite magnetite embedded therein.

The molecules of the nickel and chrome plates will align with the magnetic field and will become a magnet in itself. See FIG. 6.

The free electrons which create a magnetic field of a magnet become excited when heated. The fact is that if a magnet comes directly in contact with a flame, its free electron movement becomes so accelerated and erotic that many electrons may spin off and be lost with loss of the strength of the magnet. One of the effects of more rapid movement of these free electrons is that they generate heat. The low temperatures of professional hair dryers will stimulate more rapid movement of these electrons, but not to the extent that they will be lost, which in turn will accelerate the heating of the thermal cell thereby producing a hair roller that is capable of faster heating when an outside heat source is applied, and is capable of heat storage and will continue to dry the hair long after the heat source has been removed.

The thermal cell has the ability to conduct heat from the hot air external heat source (see FIG. 2) through its inner plate (thermal conductance movement 36) as the hot air moves through the hollow heat chamber. This thermal heat builds up in the copper inner plate and expands its thermal movement by following the plate around the radius to the outer plate where it dissipates by radiation into the hair.

It is well known in the beauty profession that wet hair wrapped around the external body of a regular hair roller insulates and slows up the heating of the roller and therefore regular rollers only act as a form and do not contribute to the drying process. The longer the hair the longer it takes to dry the set, and always the ends or the tips are last to dry, whereas the roller of this invention conducts heat through its inner plate and transmits this heat under the hair wrapped on the outer plate, thereby drying the ends first as the hot air from the dryer, drys the hair on the outside of the wrap. This combination of drying the hair from the inside of the wrap as it is also drying from the outside is a remarkable improvement.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A heaterless hair roller for curling hair by a process which comprises wrapping strands of the hair around the outer surface thereof, and exposing the wrapped strands to a separate heat source, said hair roller comprising an elongated hollow cylindrical plastic body having a metal coating on each of its surface to provide a heat conducting inner surface and a heat radiating outer surface, and means for securing the strands around the roller.

2. The hair roller of claim 1 wherein said metal coatings substantially enclose and sandwich said plastic substrate body therebetween to form a thermal energy storage cell.

3. The metallized hair roller of claim 1 wherein the said metal coatings on the inner and outer surfaces of said body comprises a series of metal layers one on the other beginning adjacent to the plastic surface, an electroless metal plate, a first electrolytic nickel plate, an electrolytic copper plate, a second electrolytic nickel plate, and an electrolytic external finish plate.

4. The metallized hair roller of claim 3 wherein the inner surface composite of electrolytic plate are continuous and integral with the outer surface composite of electrolytic plates.

5. The metallized hair roller of claim 3 wherein said finish coat comprises electrolytic chromium.

6. The metallized hair roller of claim 5 comprising a surface flash coating of gold, brass or bronze.

7. The metallized hair roller of claim 1 wherein the said plastic body is formed from an electroplatable grade plastic.

8. The metallized hair roller of claim 7 wherein said electroplatable grade plastic is an acrylonitrile-butadienestyrene terpolymer, polypropylene, a phenylene oxide polymer, polysulfone or a polyaryl ether.

9. The metallized hair roller of claim 7 wherein said electroplatable grade plastic has a particulate metal embedded therein.

10. The metallized hair roller of claim 9 wherein said metal is barium ferrite.

11. The metallized hair roller of claim 10 wherein said barium ferrite creates a permanent magnetic field throughout the roller which will accelerate the thermal conductance of the formed thermal cell plate in which it is encased when an external heat source is applied.

12. The metallized hair roller of claim 9 wherein the said metal is a magnetic metal.

13. The metallized hair roller of claim 1 wherein the ends of the elongated hollow cylindrical body have a curved radius.

14. The metallized hair roller of claim 3 wherein the said electroless metal is electroless nickel or electroless copper.

15. The metallized hair roller of claim 3 wherein all of the metal coatings are an integral part of the formed plate structure thereby creating a thermal cell.

16. The metallized hair roller of claim 3 in which said electrolytic copper plate is the thermal energy core providing heat conductance, heat storage, heat transmission and heat radiation with the thickness of the copper plate controlling the differential in the coefficient of thermal expansion between the plastic substrate and the nickel plate.

17. The metallized hair roller of claim 3 in which said electrolytic nickel plate comprises both a coating of semi-bright nickel and a coating of bright nickel encasing the copper plate and providing protection from chemicals that may react with the copper plate, said nickel plate also acting as a base for the magnetic attraction of the magnetic holders.

18. The metallized hair roller of claim 3 wherein the finish coat is highly polished, thereby providing a surface to which wet hair will cling.

19. The metallized hair roller of claim 1 wherein the said magnetic holder has a connecting plastic surface containing embedded barium ferrite or magnetite.

20. The metallized hair roller of claim 3 wherein the magnetic holders which when coming in contact with the roller will be attracted to the nickel plate and lock thereto, securing hair wrapped around the hair roller to the roller.

21. The metallized hair roller of claim 17 wherein magnetic holders which when magnetically locked to the roller will align the molecular structure of the nickel and chromium plates into a temporary magnet thereby creating a magnetic field within and around the hair roller.

22. The metallized hair roller of claim 10 or 20 wherein the magnetic field becomes excited when heated thereby contributing additional heat to the roller thermal cell due to the accelerated movement of the magnetic field free electrons.

23. The metallized hair roller of claim 19 comprising a magnetic holder is a straight bar, an end cap or strap.

24. The metallized hair roller of claim 3 wherein the electroplate coatings are substantially thicker than a decorative electroplating thereby creating an electro form.

25. The hair roller of claim 19 wherein the magnetic holder is in the form of a hair clip, roller pin, end cap, flexible strip or magnetic bar.

26. The metallized hair roller of claim 1 comprising an elongated hollow frusto-conical shaped plastic body having a metal coating on each of its surfaces to provide a heat conducting inner surface and a heat radiating outer surface.

27. The hair roller of claim 26 wherein the plate on each surface is at least 1.5 mils.

* * * * *